US006857763B2

(12) United States Patent
Keller

(10) Patent No.: US 6,857,763 B2
(45) Date of Patent: Feb. 22, 2005

(54) LUMINOUS DIODE ARRANGEMENT WITH REFLECTOR

(75) Inventor: Katharina Keller, Lindau (DE)

(73) Assignee: Zumtobel Staff GmbH, Dornbirn (AT)

( * ) Notice: Subject to any disclaimer, the term of this patent is extended or adjusted under 35 U.S.C. 154(b) by 0 days.

(21) Appl. No.: 10/217,446

(22) Filed: Aug. 14, 2002

(65) Prior Publication Data

US 2002/0191398 A1 Dec. 19, 2002

Related U.S. Application Data

(63) Continuation of application No. PCT/EP01/00934, filed on Jan. 29, 2001.

(30) Foreign Application Priority Data

Feb. 14, 2000 (DE) ..... 200 02 565 U

(51) Int. Cl.[7] ..... F21V 7/00

(52) U.S. Cl. ..... 362/247; 362/239; 362/391; 362/545; 362/800

(58) Field of Search ..... 362/235, 239, 362/238, 247, 250, 296, 391, 545, 294, 800, 231

(56) References Cited

U.S. PATENT DOCUMENTS 4,360,860 A * 11/1982 Johnson et al. ..... 362/192
5,025,357 A * 6/1991 Maurer ..... 362/249
5,084,804 A 1/1992 Schairer ..... 362/61
5,561,346 A 10/1996 Byrne ..... 313/516
5,697,584 A 12/1997 Chew ..... 246/473
5,782,553 A 7/1998 McDermott ..... 361/245
5,931,567 A 8/1999 Salzmann et al. ..... 362/304
6,155,693 A 12/2000 Spiegel et al. ..... 362/147
6,441,943 B1 * 8/2002 Roberts et al. ..... 359/267

FOREIGN PATENT DOCUMENTS

EP 570987 A1 * 11/1993 ..... B62J/6/04
JP 08046244 2/1994
JP 11-17229 1/1999

* cited by examiner

*Primary Examiner*—Sandra O'Shea
*Assistant Examiner*—Sharon Payne
(74) *Attorney, Agent, or Firm*—Fitzpatrick, Cella, Harper & Scinto

(57) ABSTRACT

The invention relates to a luminaire having a light source (2) which has at least one light emitting semiconductor, and having a, as seen from the light source (2), concave reflector (1), the light source (2) being arranged in substance in the longitudinal axis of the reflector (1). In accordance with the invention, the light source (2) is of a plurality of luminous diodes (4) arranged on a carrier surface (3) and controllable, the ratio between the carrier surface (3) and the opening of the reflector (1) being between 1:3 and 1:20.

9 Claims, 2 Drawing Sheets

LUMINOUS DIODE ARRANGEMENT WITH REFLECTOR

CROSS REFERENCE TO RELATED APPLICATIONS

This is a Continuation of International Application PCT/EP01/00934 filed Jan. 29, 2001 which in turn claims priority of German application DE 200 02 565.1, filed Feb. 14, 2000, the priorities of which are hereby claimed, said International Application having been published in German, but not in English, as WO 01/59359 A1 on Aug. 16, 2001.

BACKGROUND OF THE INVENTION

Field of the Invention

The present invention relates to a luminaire having a light emitting semiconductor and a concave reflector.

A luminaire having a light emitting semiconductor and a reflector is known, for example, from Japanese published patent application JP 11-17229. This describes an illumination arrangement with which an individual luminous diode is arranged within a reflector, so that the light emitted from this luminous diode is employed for indirect illumination. The arrangement of the light source within a reflector thereby has the advantage that light radiated from the luminous diode in a relatively great solid angle is caught by the reflector and reflected, and thus in comparison to a direct illumination by means of the luminous diode, a substantially greater quantity of light can be exploited for illumination purposes.

Such illumination arrangements can, due to the very good controllability of the light source, be employed in opto-electronic components and other display devices. The illumination arrangement described in JP 11-17229 is, however, restricted with regard to its possibilities for application, since the quantity of light emitted by the individual diode is not very high and therefore insufficient for a range of illumination purposes.

SUMMARY OF THE INVENTION

An object of the present invention is thus to improve the illumination arrangement known JP 11-17229 to the effect that this is suitable for a multiplicity of possible applications.

This object is achieved by means of a luminaire which has a plurality of luminous diodes arranged on a carrier surface whose area ratio to the area of the reflector opening is between 1:3 and 1:20. In accordance with the invention, there is employed as light source a carrier surface on which a plurality of luminous diodes are arranged. This light source is arranged in substance in the longitudinal axis of a, as seen from the light source, concave reflector; so that a large part of the light emitted by the luminous diodes can be exploited for the desired illumination purpose. Thereby, the ratio between the size of the carrier surface and the opening of the reflector is between 1:3 and 1:20.

The employment of a plurality of luminous diodes has firstly the consequence that the overall light quantity is significantly higher than that of an individual luminous diode. Further, there is provided thereby the possibility of regulating the light source with regard to its overall light intensity over a substantially greater range but nonetheless very exactly, and to set different levels of brightness. At the same time, however, the indicated size relationship between the carrier surface and the reflector has proven to be advantageous, since in this size range on the one hand sufficiently high light intensities can be attained, but on the other hand no casting of shadows by the carrier surface arranged before or within the reflector arises in the light radiated from the reflector. Preferably the relationship between the carrier surface and the opening of the reflector is 1:10.

The above-mentioned advantage that luminous diodes have a very good controllability can further be exploited in that luminous diodes of different colours are arranged in common on the carrier surface. Now, along with the known red and green luminous diodes, also blue luminous diodes having a relatively high efficiency can be produced, so that by means of a suitable combination of these three colours, or by means of an appropriate control of the luminous diodes arranged on the carrier surface, colour tones can be obtained as desired. Thus, the luminaire in accordance with the invention can be employed for a multiplicity of application purposes.

The very compact arrangement of the light emitting semiconductors on the substrate may have the consequence that there is generated a relatively high heat power. A practical configuration of the invention can thus consist in that on the reverse side of the carrier surface—that is the side opposite to the luminous diodes—there is arranged a cooling body which effectively radiates away the generated heat power. Since the weight of the light source is relatively small, the current and/or control lines for the luminous diodes can preferably be directly used for mounting the light source. These may for example span in a diameter across the reflector, so that the light source is arranged in substance in the plane of the reflector opening. A further possibility can, however, also consist in that the current or control lines used for the mounting extend, from the reflector inner side or the reflector centre, in the direction towards the reflector opening, so that the spacing of the light source from the reflector is selectable. Particularly advantageously, the light source is located in the focus of the reflector, since this arrangement ensures a maximum utilisation of the radiated light.

BRIEF DESCRIPTION OF THE DRAWINGS

Below, the invention will be explained in more detail with reference to the accompanying drawings.

DETAILED DESCRIPTION OF THE PREFERRED EMBODIMENT

Figure 1:
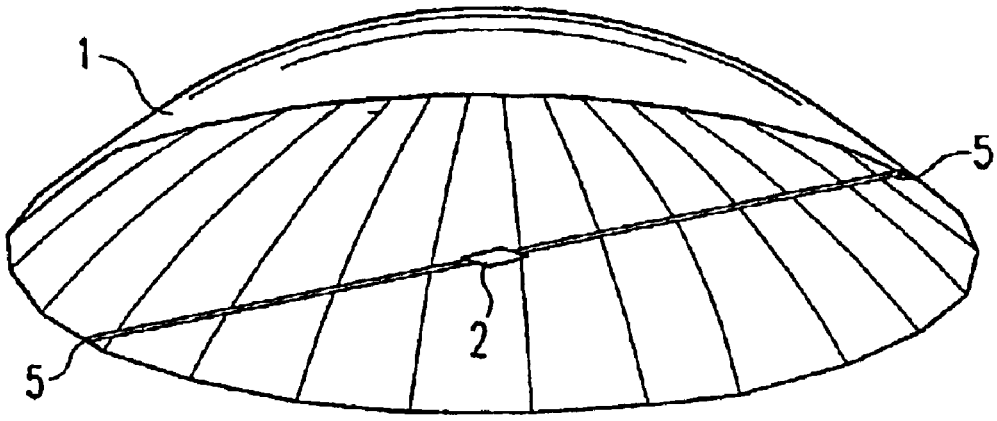
FIG. 1 is a perspective view of a luminaire in accordance with the invention.

FIG. 1 shows a very general exemplary embodiment of a luminaire in accordance with the invention. A main element of this luminaire is a dome-shaped or concave reflector 1 the inner walls of which are highly reflecting. A light source 2 is arranged at the intersection point of the longitudinal axis of the reflector 1 with its opening plane, which light source is of a plurality of luminous diodes arranged on a carrier surface. The current supply and the control of the individual luminous diodes is effected via current and control lines 5 which span across the reflector in a diameter from one edge of the reflector opening to the other, and serve at the same time as mounting for the light source 2. A particularly advantageous configuration consists in that the light source 2 is arranged at the focal point of reflector 1, so that the entire upwardly radiated light, over an angular range of 180°, of the luminous diodes can be employed for the intended illumination purpose.

Figure 2:
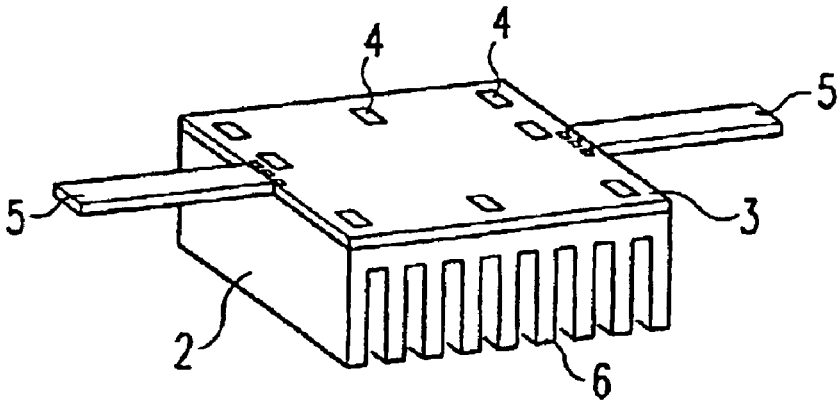
FIG. 2 is a perspective view showing in more detail the configuration of a light source in accordance with the invention.

FIG. 2 shows an enlarged illustration of the light source 2 in accordance with the invention. On a carrier surface 3 there are arranged a plurality of luminous diode chips (dice) 4. These can emit light in each case in different colours, so that with a suitable control of the luminous diodes 4 there can be attained different colour tones for the light emitted from the luminaire overall. On the side of the carrier surface 3 away from the luminous diodes 4 there is arranged a cooling body 6, for increasing heat radiation. By these means there is avoided an overheating of an overall light source 2 and thus an adverse effect on the efficiency of, or even damage to, the luminous diodes 4. The two connection lines 5 serve both for current supply and also for the transmission of control signals for the purposive control of the various luminous diodes 4, in order to attain the desired colour tone.

By means of the compact arrangement of the luminous diode chips a considerable light intensity can be attained, so that the luminaire is also suitable for applications in which high light intensities are needed. At the same time, however, a homogeneous illumination is achieved through the light emitted from the reflector 1. The size relationship between the carrier surface 3 and the reflector 1 indicated in accordance with the invention thereby ensures that the light source 2 itself does not give rise to casting of shadows. In order to additionally promote the generation of a uniform light radiation it can be provided that the inner side of the reflector diffusely reflects the light emitted by the luminous diodes 4, which further also promotes a mixing of the different colour tones.

Figure 3A:
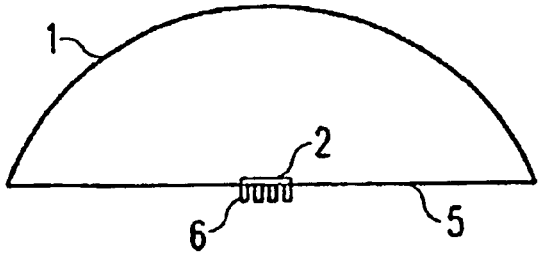
FIGS. 3*a*–3*c* are diagrammatic views showing various mounting possibilities for the light source of FIG. 2.
Figure 3B:
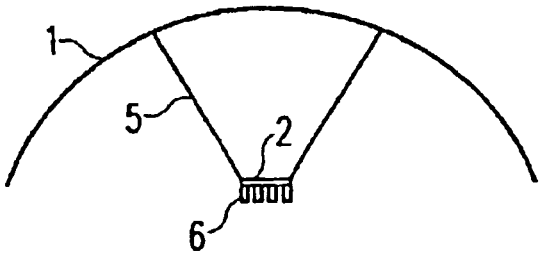
Figure 3C:
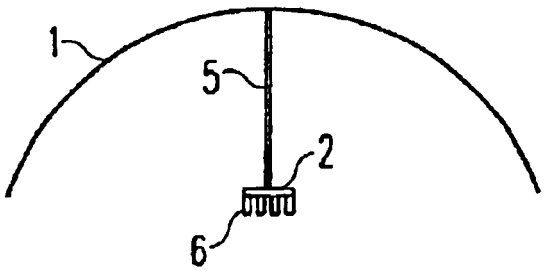

With reference to FIGS. 3*a* to 3*c* there will now be explained various mounting possibilities for the light source 2 within the dome-like reflector 1.

The mounting illustrated in FIG. 3*a* thereby corresponds to the luminaire illustrated in FIG. 1. As mounting for the light source 2 there thereby serve the current or control lines 5, which span across the reflector 1 from the edge in the manner of a diameter, whereby the light source 2 is arranged exactly in the middle and thus in the longitudinal axis of the reflector 1.

A means of suspension alternative thereto is illustrated in FIG. 3*b*, in which the current and control lines 5 extend obliquely downwardly from the inner side of the reflector, which has the advantage that the light source 2 need not necessarily be arranged in the plane of the reflector opening, but may for example be arranged also further within the reflector 1 or even protruding therefrom. This possibility exists also with the third mounting illustrated in FIG. 3*c*, in which the light source 2 is formed by means of a rod-shaped mounting 5, extending from the reflector centre along the longitudinal axis of the reflector 1, which likewise can contain the current and control lines. Here, for example, it can also be provided that the light source 2 is adjustable in its spacing to the reflector 1, so that by means of a displacement along the longitudinal axis the light cone produced by means of the reflector 1 can be varied.

What is claimed is:

1. A luminaire comprising:

a concave dome-shaped reflector having a longitudinal axis and an opening having an area;

a light source, including a carrier located in the vicinity of said opening at said longitudinal axis, said light source further including a plurality of controllable luminous diode chips arranged on a surface of said carrier which faces said reflector, the areas of said carrier surface and of said opening having a ratio between 1:3 and 1:20; and a cooling body arranged on a surface of the carrier surface which faces away from said reflector.

2. A luminaire according to claim 1, wherein the ratio between the areas of said carrier surface and said opening being 1:10.

3. A luminaire according to claim 1, wherein said luminous diode chips emit light in different colors.

4. A luminaire comprising, a concave dome-shaped reflector having a longitudinal axis and an opening having an area;

a light source, including a carrier located in the vicinity of said opening at said longitudinal axis, said light source further including a plurality of controllable luminous diode chips arranged on a surface of said carrier which faces said reflector, the areas of said carrier surface and of said opening having a ratio between 1:3 and 1:20; and a cooling body arranged on a surface of the carrier surface which faces away from said reflector wherein said light source is held by current or control lines.

5. A luminaire according to claim 4, wherein said lines span across said concavity opening.

6. A luminaire according to claim 4, wherein said current or control lines extend from at least one point on an inner surface of said reflector to said opening.

7. A luminaire according to claim 6, wherein said light source is adjustable in its spacing from the reflector.

8. A luminaire according to claim 1, wherein said light source is arranged at a focal point of said reflector.

9. A luminaire according to claim 1, wherein said reflector has an inner concave surface which is diffusely reflecting.

* * * * *